United States Patent [19]

Thornburgh

[11] Patent Number: 4,778,029

[45] Date of Patent: Oct. 18, 1988

[54] ENGINE AIR INLET AND SILENCER FOR MOTOR VEHICLE

[75] Inventor: William F. Thornburgh, Rochester Hills, Mich.

[73] Assignee: General Motors Coporation, Detroit, Mich.

[21] Appl. No.: 120,361

[22] Filed: Nov. 13, 1987

Related U.S. Application Data

[63] Continuation-in-part of Ser. No. 043972, Apr. 29, 1987, abandoned.

[51] Int. Cl.[4] ..... F02M 35/00

[52] U.S. Cl. ..... 181/229; 181/258; 181/263; 180/68.3

[58] Field of Search ..... 181/229, 258, 261, 263; 180/68.3, 69.21

[56] References Cited

U.S. PATENT DOCUMENTS

| | | | |
|---|---|---|---|
| 2,701,024 | 2/1955 | Thomas | 181/229 X |
| 2,875,840 | 3/1959 | Klenm | 180/68.3 |
| 2,881,860 | 4/1959 | Ternes | 181/229 X |
| 2,954,096 | 9/1960 | McMullen | 181/229 X |
| 3,249,172 | 5/1966 | De Loreau | 181/229 X |
| 3,481,119 | 12/1969 | McKinlay | 180/68.3 X |
| 4,058,096 | 11/1977 | Brown | 123/542 |
| 4,133,547 | 1/1979 | Fox | 180/68.3 |
| 4,136,756 | 1/1979 | Kawamura | 181/229 |
| 4,235,298 | 11/1980 | Sackett et al. | 180/68.3 |

*Primary Examiner*—B. R. Fuller

*Attorney, Agent, or Firm*—R. L. Phillips

[57] ABSTRACT

A noise attenuating tube mounted in an engine compartment air intake hood duct of a motor vehicle to attenuate engine air intake noise in the hood is disclosed.

3 Claims, 2 Drawing Sheets

ENGINE AIR INLET AND SILENCER FOR MOTOR VEHICLE

TECHNICAL FIELD

This is a continuation-in-part of U.S. patent, application Ser. No. 043,972, filed Apr. 29, 1987 now abandoned.

This invention relates to engine air inlets and silencers for motor vehicles and more particularly to those utilizing an engine compartment hood to form a duct to the engine's air cleaner assembly.

BACKGROUND OF THE INVENTION

In those motor vehicles having an engine air inlet duct or passage formed by and between the engine compartment hood and an inner panel, the practice has been to arrange the duct so as to direct cold air from the windshield area to the inlet of an air cleaner assembly mounted within the engine compartment and on which the hood duct seals when the hood is closed. In addition to the desirably cold air, the hood duct provides water separation by inertia and the hood may be lifted to provide service to the air filter with the air filter then being sealed even when the hood is open. Typically, the air cleaner assembly is mounted on the engine's carburetor or throttle body in the case of fuel injection and/or diesel engine or is packaged remotely and plumbed to the engine's intake system. In addition, a mass air flow sensor may be a part of the air cleaner system. But in either case, there has heretofore been nothing to add any significant acoustical impedance to the system to help attenuate the noise that can be generated with such a hood duct.

SUMMARY OF THE PRESENT INVENTION

The present invention provides a means of silencing the intake noise that can accompany a hood duct without disturbing any of the conventional components in the system. This is accomplished by simply adding a silencing tube in the hood duct with a coincidental outlet. Preferably, the tube has a reduced and flared inlet facing toward the hood duct inlet and an expanding flow area along its length with the tube length and size and amount of inlet flare all selected to produce a smooth but significant flow restriction that results in the desired silencing.

With the above in mind, an object of the present invention is thus to provide a new and improved engine air inlet passage in an engine compartment hood of a motor vehicle.

Another object is to provide a silenced engine air inlet duct in the engine compartment hood of a motor vehicle.

Another object is to provide in an engine air inlet duct in a motor vehicle compartment hood, a silencer tube with an outlet at the inlet to the air cleaner and a flared inlet facing toward the inlet of the hood duct and the windshield area.

These and other objects, advantages and features of the present invention will become more apparent from the following description and drawing in which:

DESCRIPTION OF THE DRAWING

Referring to FIG. 1, there is shown an air cleaner assembly 10 mounted on a support bracket 12 in the frontwardly located engine compartment 14 of a leftwardly facing motor vehicle (only a front midportion thereof being shown). The air cleaner assembly 10 comprises an upper shell 18 and a lower shell 20 which enclose and support by clamping a panel filter 22 having a screen 24 on its upstream side. The upper shell 18 has an inlet 26 in the form of a circular hole that faces upwardly in the engine compartment and the lower shell 20 has an outlet 28 in the form of a tubular extension that extends generally horizontally and rearwardly and is connected by a corrugated conduit 30 to the engine's air intake (not shown). The vehicle which faces leftwardly as viewed in the drawing, has an inner panel 32 which is connected to the underside of the hood 16 and forms therewith and therebetween an air inlet duct 34 having an inlet which faces rearwardly of the vehicle so as to direct outside or atmospheric air from the base of the windshield (not shown) to the inlet of the air cleaner assembly. An elastomeric annular seal 36 bonded to the top of the air cleaner about the latter's inlet 26 acts to seal the hood duct 34 at a downwardly extending tubular outlet 40 thereof to the air cleaner inlet 26, the hood duct outlet 40 being formed integral with and extending downwardly from the inner panel 32.

Figure 1:
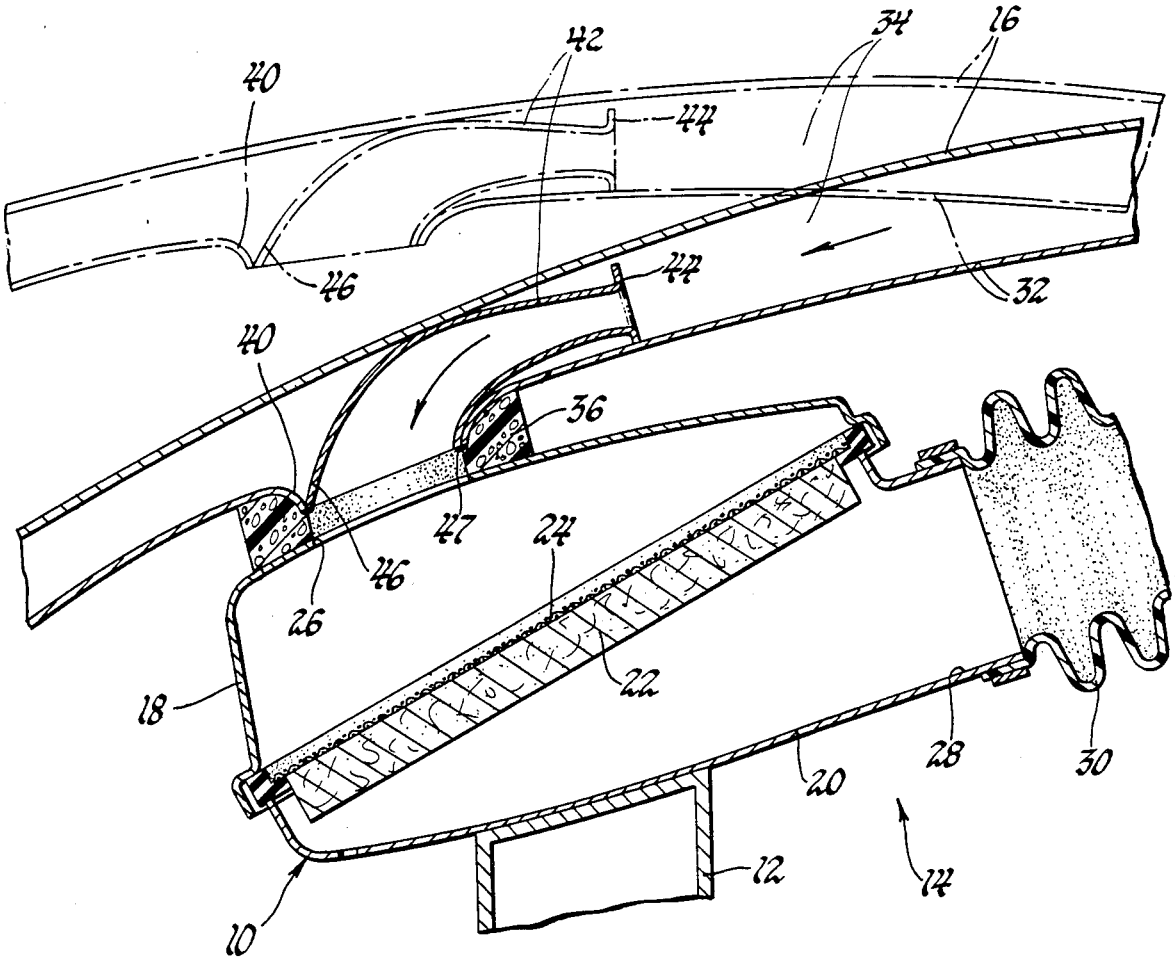
FIG. 1 is a diagrammatic sectional view of one embodiment of the engine air inlet and silencer installed in a motor vehicle.

Acoustic impedance to attenuate air intake noise in the hood is provided by a silencer tube 42 mounted in the hood duct 34. The silencer tube which may also be called a noise attenuating tube has a radially outwardly flared inlet end 44 that faces the inlet of the hood duct and an outlet 46 that fits within the normal outlet 40 of the hood duct. The silencer tube is sealingly joined about its outlet to the hood duct outlet by a weld bead 47 and has an expanding flow area along its length from its reduced inlet. The length and path shape and amount of inlet flare of the silencer tube 42 are determined according to conventional acoustical criteria so as to give the desired silencing with a tolerable restriction with respect to the particular engine's breathing requirements.

Figure 2:
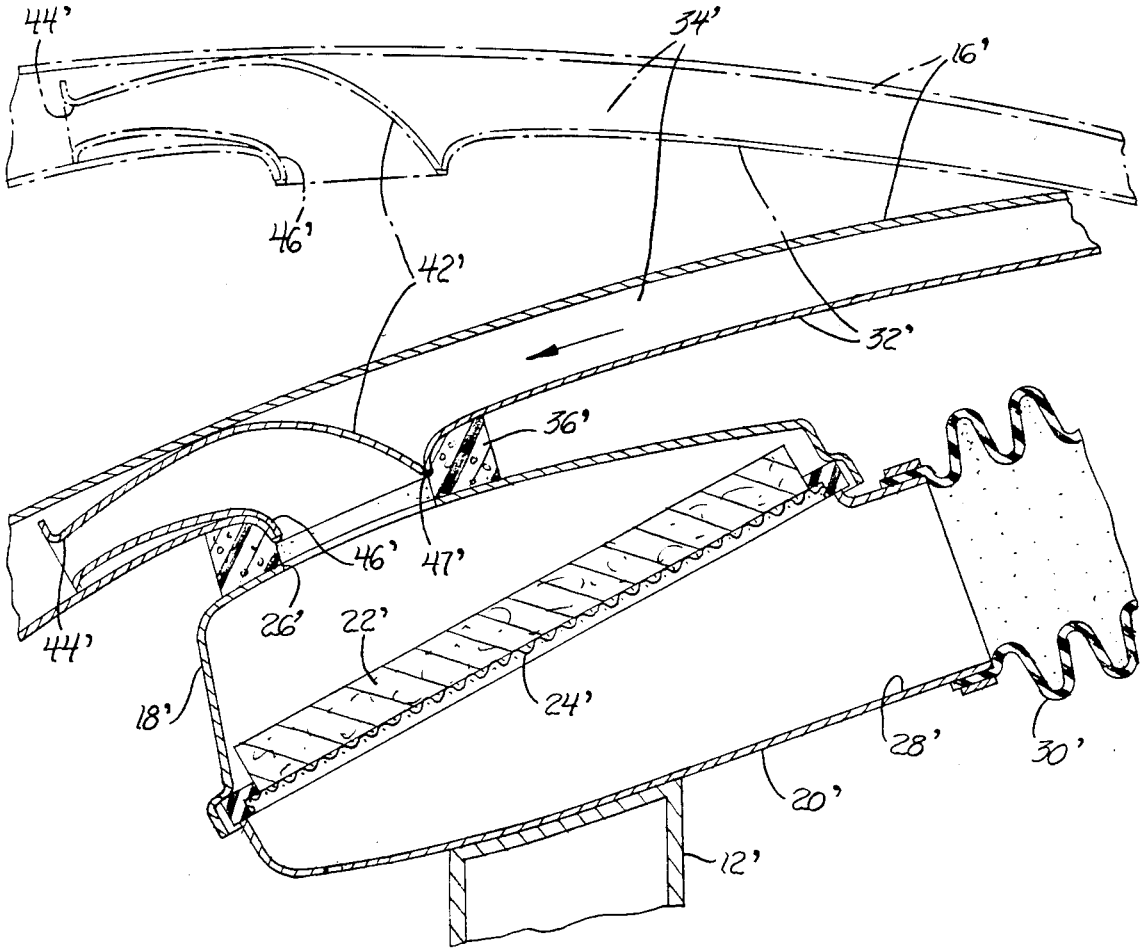
FIG. 2 is a view similar to FIG. 1 but of another embodiment.

In the FIG. 2 embodiment wherein parts similar to those in FIG. 1 are identified by the same numbers only primed, the direction of the silencer tube 42' is reversed so that the inlet end 44' faces forward of the vehicle. This has been found to render the system even quieter than that in FIG. 1 because of the greater distance and directional effect of the sound relative to the listener. Moreover, more efficient flow leading to even less noise has been found to result from reversing the position of the filter 22' and screen 24' with the former then located upstream as shown in FIG. 2.

The foregoing description of the preferred embodiment of the invention have been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The embodiments of the invention in which an exclusive property or privilege is claimed are defined as follows:

1. In a motor vehicle having an engine compartment covered by a hood and containing an engine air cleaner assembly with an upwardly facing inlet, the improvement comprising an inner panel fixed to an underside of the hood and forming therewith an air inlet duct having an inlet at the hood open to atmosphere and an outlet at the inner panel that locates directly above the inlet of the air cleaner assembly when the hood is closed, a seal for sealing the hood duct outlet to the air cleaner assembly inlet when the hood is closed, a noise attenuating tube mounted in the hood duct, said tube having an inlet located intermediate the length of the hood duct facing rearwardly of the vehicle, and said tube having an outlet located in the hood duct outlet so as to be sealingly connected to the inlet of the air cleaner when the hood is closed.

2. In a motor vehicle having an engine compartment covered by a hood and containing an engine air cleaner assembly with an upwardly facing inlet, the improvement comprising an inner panel fixed an underside of the hood and forming therewith an air inlet duct having an inlet at the hood open to atmosphere and an outlet at the inner panel that locates directly above the inlet of the air cleaner assembly when the hood is closed, a seal for sealing the hood duct outlet to the air cleaner assembly inlet when the hood is closed, a noise attenuating tube mounted in the hood duct, said tube having an inlet located intermediate the length of the hood duct facing forwardly of the vehicle, and said tube having an outlet located in the hood duct outlet so as to be sealingly connected to the inlet of the air cleaner when the hood is closed.

3. In a motor vehicle having an engine compartment covered by a hood and containing an engine air cleaner assembly with an upwardly facing inlet, the improvement comprising an inner panel fixed to an underside of the hood and forming therewith an air inlet duct having an inlet at the hood open to atmosphere and an outlet at the inner panel that locates directly above the inlet of the air cleaner assembly when the hood is closed, a seal for sealing the hood duct outlet to the air cleaner assembly inlet when the hood is closed, a noise attenuating tube mounted in the hood duct, said tube having an inlet located intermediate the length of the hood duct, and said tube having an outlet located in the hood duct outlet so as to be sealingly connected to the inlet of the air cleaner when the hood is closed and said air cleaner assembly comprising a filter having a screen mounted on an upstream side thereof.

* * * * *